United States Patent [19]

Tenmyo et al.

[11] 4,054,447

[45] Oct. 18, 1977

[54] STEEL RESISTANT TO INTERGRANULAR STRESS CORROSION CRACKING

[76] Inventors: Gennosuke Tenmyo, 11-11, Honmachi, Den-enchofu, Ota-ku, Tokyo; Masayuki Tanimura, 51, Tokiwadai, Hodogaya; Toshio Nakazawa, 786-1, Hinomachi, Konan, both of Yokohama, all of Japan

[21] Appl. No.: 661,517

[22] Filed: Feb. 26, 1976

Related U.S. Application Data

[63] Continuation of Ser. No. 443,035, Feb. 15, 1974, abandoned.

[30] Foreign Application Priority Data

Feb. 16, 1973 Japan ..... 48-18408

[51] Int. Cl.[2] ..... C22C 38/06; C22C 38/14

[52] U.S. Cl. ..... 75/124; 75/123 H; 75/126 F; 75/128 Z

[58] Field of Search ..... 75/124, 123 H, 126 F, 75/128 Z, 123 J; 148/36

[56] References Cited

U.S. PATENT DOCUMENTS

| | | | |
|---|---|---|---|
| 3,216,823 | 11/1965 | Gulya | 75/128 Z X |
| 3,259,488 | 7/1966 | Nakamura | 75/124 |
| 3,328,211 | 6/1967 | Nakamura | 75/124 X |
| 3,666,570 | 5/1972 | Korchynsky | 75/123H X |
| 3,671,336 | 6/1972 | Korchynsky | 75/123 H X |
| 3,897,245 | 7/1975 | Savas | 75/124 |

*Primary Examiner*—Arthur J. Steiner

[57] ABSTRACT

A steel resistant to intergranular stress corrosion cracking having the composition: C up to 0.20%, Si 0.05 - 0.80%, Mn 0.30 - 1.50%, P up to 0.03%, S up to 0.03%, Al (sol. Al) 0.05 - 0.25%, Zr 0.03 - 0.20%, the balance being iron and unavoidable impurities. Another intergranular stress corrosion cracking resisting steel is disclosed which contains one or both of 0.10 - 0.30% Cr and 0.10 - 0.50% Ni in addition to the composition of the first-mentioned steel.

2 Claims, 3 Drawing Figures

(a) LOCK WELDED TEST PIECE DIMENSIONS(mm)

(b) WELDING METHOD WELDING ROD 4mmφ 3PASSES

STEEL RESISTANT TO INTERGRANULAR STRESS CORROSION CRACKING

This application is a continuatin of co-pending application Ser. No. 443,035 filed Feb. 15, 1974, now abandoned.

BACKGROUND OF THE INVENTION

The present invention relates to an economical steel which is capable of preventing intergranular stress corrosion cracking that occurs when a steel is placed in contact with nitrogen oxides at temperatures below their dew point, rendering the steel unusable.

While the problem of air pollution has generally led to various attempts to ensure the complete combustion of gases at elevated temperatures, the combustion of gases at elevated temperatures has presented a number of new corrosion problems to which no consideration has heretofore been paid. In other words, when various gases are burnt at elevated temperatures, nitrogen oxides are eventually produced in very large amounts and these nitrogen oxides cause cracks in the steel parts of installations thus rendering them unfit for use and longer. Such cracks occur along the intergranular boundaries and one form of heretofore known cracking phenomenon similar to such cracks is stress corrosion cracking caused by nitrates. How such integranular stress corrosion cracking of steel due to nitrogen oxides occurs has not been clarified as yet. It is not conceivable, however, that gases such as NO, $NO_2$ and $NO_3$ per se have a direct effect on the causing of such cracks, but it is considered that condensation of such gases under the effects of temperature, pressure and the like, reaction of such gases with other substances present in the environment, or a complicated combination of such reactions results in the formation of $NO_3^-$ ions and these $NO_3^-$ ions are responsible for the occurrence of integranular cracking in the steel under applied or residual stresses. On the other hand, while there are also cases where alkaline solutions are frequently responsible for the intergranular stress corrosion cracking of a steel, the extent of this cracking is much less as compared with that of the cracking caused by nitrates. According, the safety of a metal against its intergranular stress corrosion cracking in alkaline solutions has heretofore been evaluated by the results of the tests in nitrates.

Further, in the above-mentioned nitrate corrosive environments, a passive thin film of magnetite is formed on the surface of steel and thus the general corrosion is not so severe and there is a tendency to use ordinary plain carbon steels in these environments. However, when such steels are used in these environments under stress which may be the residual stresss set up therein during welding, or working stress applied during operation, integranular stress corrosion cracking occurs which pevents accurate estimation of the life of the steel. Generally, while stainless steels show resistance to corrosion by nitrates or nitric acids and are thus well suited for use in these environments, it is very expensive and uneconomical to fabricate a large structure or the entire equipment of a stainless steel. For this reason, some steels which are inexpensive as compared with stainless steels, such as, 2% Cr - 0.8% Al steel and 0.4% Al steel have been developed and marketed for use in these environments. However, these steels must be subjected to heat treatments and contain alloying elements in large amounts. Moreover, in the manufacture of these steels, the addition of aluminum in a large amount tends to give rise to a poor fluidity, rough ingot skin and the like which result in an increase in the manufacturing costs, and therefore the manufacture of these steels is not preferred in the industry. Furthermore, the addition of aluminum to a steel tends to seriusly deteriorate the weldability and impact resistance properties of the steel and hence it is difficult to use them in a large welded structure. Thus, there has existed a need for the development of a steel containing aluminum in a relatively small amount. On the other hand, while it has been reported that subjecting the weld zones, of a structure made of ordinary plain carbon steel to a stress relieving annealing is effective in preventing cracking, this annealing results in a large distortion. Moreover, it is practically impossible to perform a stress relieving annealing on a large welded structure. This also involves difficult problems in respect of manufacture, delivery date and manufacturing costs.

Therefore, there exists the need for a steel which overcomes the foregoing difficulty relating to the weldability, impact resistance properties, workability and resistance to integranular stress corrosion cracking and which is as inexpensive as ordinary plain carbon steels.

SUMMARY OF THE INVENTION

It is an object of the present invention to provide a steel which meets these requirements. The steel according to the present invention which has been the result of extensive studies on the effects of various alloying elements on the resistance of steels to intergranular stress corrosion cracking in gaseous or aqueous environments containing nitrogen oxides or similar corrosive substances, is a low-alloy steel which is highly economical, superior in weldability and highly resistant to integranular stress corrosion cracking. More particularly, the steel according to the invention occurs in proper amounts aluminum and zirconium which are effective in preventing integranular stress corrosion cracking as well as chromium and/or nickel useful for imparting an improved corrosion resistance and impact resistance properties, and thus the steel possesses excellent properties which have heretofore been attained only by the addition of alloying elements in large amounts.

BRIEF DESCRIPTION OF THE DRAWING

FIG. 2 shows an immersion test tank used in the same test.

DESCRIPTION OF THE PREFERRED EMBODIMENTS

Figure 1A:
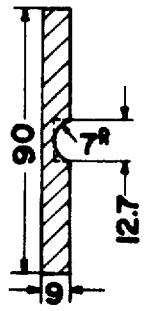
FIG. 1*a* is a section taken along line A—A in FIG. 1.

The present invention will now be described in greater detail. In accordance with the present invention, there is provided a novel steel resistant to intergranular stress corrosion cracking having the following composition: up to 0.20% C, 0.05 - 0.80% Si, 0.30 - 1.50% Mn, up to 0.03% P, up to 0.03% S, 0.05 - 0.25% Al (sol Al), 0.03 - 0.20% Zr, the balance being iron and unavoidable impurities. According to another form of the invention, there is provided a novel intergranular stress corrosion cracking resisting steel of the type just described which further contains at least one of 0.10 - 0.30% Cr and 0.10 - 0.50% Ni.

The reasons for selecting the above-mentioned composition in the present invention are as follows. The upper limit of the carbon content is set at 0.20%, since carbon in amounts above 0.20% has a detrimental effect on weldability though said amounts are advantageous in imparting resistance to integranular stress corrosion cracking. Silicon is added to effect deoxidization and impart an improved strength and resistance to integranular stress corrosion cracking. If the silicon content is less than 0.05%, the desired effects cannot be achieved, whereas if the silicon content is above 0.80%, the impact resistance properties of the steel will be considerably deteriorated. The purpose of the manganese addition is to effect deoxidization and provide improved strength and weldability. A manganese content of less than 0.30% cannot achieve this desired effect, and manganese in amounts above 1.50% is unfavorable since there is the danger of causing the manganese to segregate thereby making the steel heterogeneous. Phosphorus and sulfur which are unavoidable impurities in steelmaking are limited up to 0.030% respectively. Aluminum (sol. Al) which is an essential element like zirconium for preventing intergranular stress corrosion cracking, does not shown a marked effect if it is added in amounts less than 0.05%, whereas the addition of aluminum in amounts above 0.25% tends to give rise to manufacturing difficulties and also has a detrimental effect on weldability. While zirconium is effective in preventing integranular stress corrosion cracking, the addition of less than 0.03% Zr cannot achieve the desired effect, whereas the addition of above 0.20% Zr seriously deteriorates the impact resistance properties of the steel. While the addition of chromium promotes the formation of a passive film which increases the corrosion resistance as mentioned earlier, amounts of chromium exceeding 0.30% seriously deteriorate the resistance of the steel to intergranular stress corrosion cracking and therefore the upper limit is set at 0.30%. However, since the addition of chromium in amounts below 0.30% has no directly beneficial effect against intergranular stress corrosion cracking itself, no lower limit is particularly set for the chromium content. A small amount of chromium which may be introduced naturally during the refining of steel is allowable, although the addition of chromium in amounts above 0.10% is preferred if the general corrosion resistance is to be improved. Further, nickel is added to increase strength and impact resistance properties without any detrimental effect on intergranular stress corrosion cracking resistance. This effect cannot be obtained with a nickel content of less than 0.10%, while a nickel content exceeding 0.50% is rather disadvantageous from an economical point of view. While the content of chromium and nickel are limited for the reasons described above, the addition of at leaast one of chromium and nickel in the above ranges to the previously mentioned composition results in a steel having well-balanced properties as to resistance to intergranular stress corrosion cracking, corrosion resistance and impact resistance.

Figure 1:
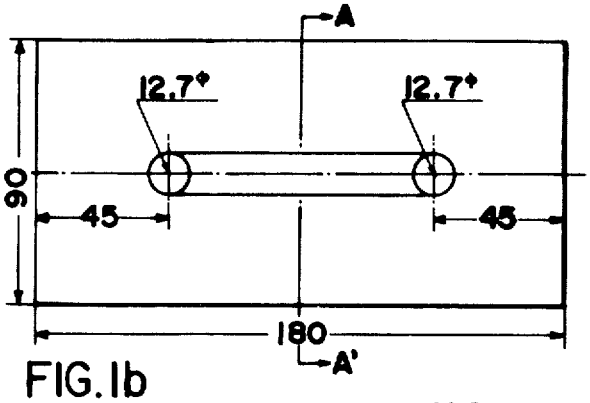
FIG. 1 is a plan view which shows a test piece used in the test for examining the integranular stress corrosion cracking resistance applied to the steel according to the present invention.
Figure 1B:
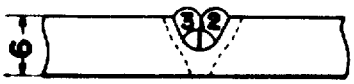
FIG. 1b shows the weld zone of the test piece.
Figure 1B:
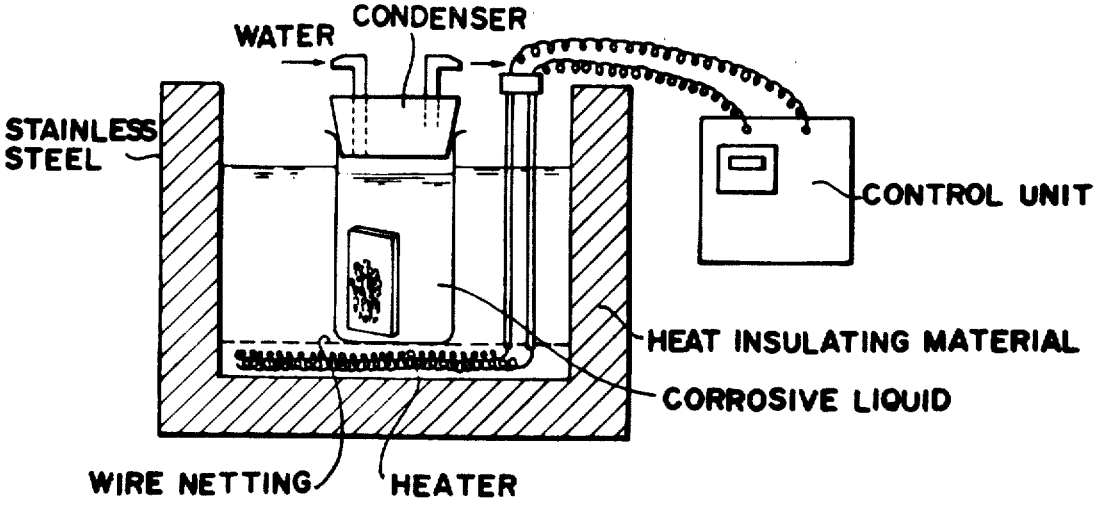

The following Table 1 shows the results of comparison tests between the steels according to this invention and comparative steels, which were conducted with respect to their mechanical properties and the presence of intergranular stress corrosion cracking. In the test method used for carrying out the intergranular stress corrosion cracking tests of Table 1, each test piece took the form of a two round hole restraint-welded piece developed by the inventors as shown in FIG. 1, and the test piece was immersed for 24 hours in a boiling (at about 110° C) 50% $NH_4NO_3$ aqueous solution after which it was checked for the presence of cracks. In the impact tests, the full size 2 mm V-notched Charpy impact specimen was employed.

Table 1

| Steel | Composition & Properties | Chemical Composition (%) C | Si | Mn | P | S | Al | Zr | Cr | Ni | Tensile Properties: Yield Point (Kg/mm²) | Tensile Strength (Kg/mm²) | Impact Properties: Eo Kg m | Tr S (° C) | Grain Boundary Stress Corrosion Cracking Test (Presence of Cracking) |
|---|---|---|---|---|---|---|---|---|---|---|---|---|---|---|---|
| Steel according to Invention | A | 0.16 | 0.39 | 1.27 | 0.009 | 0.004 | 0.072 | 0.031 | 0.24 | — | 36.9 | 53.9 | 13.6 | −14 | None |
| | B | 0.15 | 0.21 | 1.16 | 0.016 | 0.006 | 0.145 | 0.060 | 0.06 | — | 35.2 | 52.1 | 14.3 | − 9 | None |
| | C | 0.16 | 0.37 | 1.18 | 0.011 | 0.005 | 0.246 | 0.044 | 0.24 | — | 34.7 | 51.6 | 14.3 | −28 | None |
| | D | 0.17 | 0.42 | 1.26 | 0.012 | 0.005 | 0.100 | 0.042 | 0.05 | 0.28 | 37.3 | 55.8 | 19.8 | −62 | None |
| | E | 0.14 | 0.28 | 1.19 | 0.010 | 0.005 | 0.090 | 0.050 | 0.20 | 0.23 | 34.0 | 50.8 | 14.8 | −53 | None |
| Comparison Steel | F | 0.16 | 0.35 | 1.24 | 0.009 | 0.004 | 0.088 | 0.028 | 0.25 | — | 35.0 | 52.7 | 6.3 | + 8 | Present |
| | G | 0.16 | 0.43 | 1.29 | 0.009 | 0.004 | 0.173 | 0.029 | 0.23 | — | 37.0 | 53.5 | 11.7 | −27 | Present |
| | H | 0.16 | 0.35 | 1.18 | 0.020 | 0.006 | 0.383 | — | 0.23 | — | 33.1 | 54.5 | 7.0 | +10 | None |
| | I | 0.15 | 0.20 | 1.12 | 0.015 | 0.005 | 0.030 | 0.040 | — | — | 34.2 | 50.1 | 11.0 | 0 | Present |
| | J | 0.13 | 0.17 | 1.10 | 0.013 | 0.008 | 0.012 | — | — | — | 32.2 | 48.5 | 14.3 | − 9 | Present |
| | K | 0.16 | 0.45 | 1.24 | 0.020 | 0.006 | 0.190 | — | 0.24 | — | 38.1 | 54.1 | 11.8 | − 2 | Present |
| | L | 0.15 | 0.20 | 1.18 | 0.014 | 0.008 | 0.070 | 0.035 | 0.39 | — | 36.9 | 54.5 | 8.9 | − 3 | Present |

It will be seen from the above Table 1 that the steels according to the present invention showed excellent resistance to intergranular stress corrosion cracking only with the addition of certain alloying elements in small amounts. Though the comparative high aluminum steel H does not shown any intergranular stress corrosion cracking, its inferior impact resistance properties indicate that this steel is not suited for use in the fabrication of welded structures.

It should be appreciated that the steel according to the present invention, by virtue of the above-mentioned advantages, can be used for vessels, pipes and structures which are used in environments containing nitrogen oxide gases or solutions or nitrates and in other corrosive environments, e.g., in alkaline solution environments, where there is the danger of causing intergranular stress corrosion cracking with ordinary plain carbon steels. Furthermore, the steel according to the invention may be subjected to normalizing or normalizing (and) tempering to further improve its resistance to intergranular stress corrosion cracking and increase its impact resistance properties.

What is claimed is:

1. A steel resistant to intergranular stress corrosion cracking consisting essentially of up to 0.20% C, 0.05 - 0.80% Si, 0.30 - 1.50% Mn, up to 0.03% P, up to 0.03% S, 0.05 - 0.25% Al (Sol. Al), 0.03 - 0.20% Zr, the balance being iron and unavoidable impurities.

2. A steel as defined in claim 1 further containing at least one of 0.10 - 0.30% Cr and 0.10 - 0.50% Ni.

* * * * *